US005788098A

United States Patent [19]

Mader

[11] Patent Number: 5,788,098

[45] Date of Patent: Aug. 4, 1998

[54] CHILD RESISTANT CONTAINER CLOSURE SYSTEM WITH LOCKING RING, HOOK ELEMENT, AND CAP

[76] Inventor: Stanley C. Mader, 301 Windermere Ave., Asbury Park, N.J. 07712

[21] Appl. No.: 788,120

[22] Filed: Jan. 23, 1997

[51] Int. Cl.[6] ..... B65D 55/02

[52] U.S. Cl. ..... 215/219; 215/221; 215/218; 215/330

[58] Field of Search ..... 215/206, 201, 215/219, 217, 220, 221, 901, 330, 273, 274, 218; 220/319

[56] References Cited

U.S. PATENT DOCUMENTS

| | | | |
|---|---|---|---|
| 940,125 | 11/1909 | Bryan . | |
| 2,980,275 | 4/1961 | Lundgren | 215/330 |
| 3,547,295 | 12/1970 | Landen . | |
| 3,627,160 | 12/1971 | Horvath | 215/206 X |
| 3,693,820 | 9/1972 | Linkletter . | |
| 3,902,620 | 9/1975 | McIntosh . | |
| 3,910,442 | 10/1975 | Gargano . | |
| 4,006,836 | 2/1977 | Micallef | 215/218 |
| 4,154,353 | 5/1979 | Hoo . | |
| 4,482,068 | 11/1984 | Agbay et al. . | |
| 4,613,051 | 9/1986 | Swartzbaugh | 215/225 |
| 4,645,087 | 2/1987 | Kusz | 220/319 X |
| 5,082,129 | 1/1992 | Kramer | 215/221 |
| 5,224,615 | 7/1993 | Hickerson | 215/330 X |
| 5,246,123 | 9/1993 | Kramer et al. | 215/220 |
| 5,397,008 | 3/1995 | Glynn | 215/225 |
| 5,462,181 | 10/1995 | Glynn . | |
| 5,462,182 | 10/1995 | Opresco . | |
| 5,544,768 | 8/1996 | Gargione . | |

FOREIGN PATENT DOCUMENTS

| | | | |
|---|---|---|---|
| 2931343 | 2/1981 | Germany | 215/220 |

*Primary Examiner*—Stephen K. Cronin
*Assistant Examiner*—Robin A. Hylton
*Attorney, Agent, or Firm*—Nixon & Vanderhye P.C.

[57] ABSTRACT

A container with a tamper-resistant closure system has a minimum umber of simple parts yet effectively has a tamper-resistant function. A container neck has an annular flange spaced from an upper opening. A locking ring is positioned surrounding the neck below the annular flange and has a hook element that extends upwardly past the annular flange. A cap closes the upper opening of the neck and has an annular lip at an open end, a notch formed in the lip having a width slightly greater than the width of the hook element. The hook element passes through the notch and then engages the annular lip to prevent detachment of the cap unless the hook element and notch are aligned. The locking ring may have an inwardly-extending radial flange which passes through a cut-out in the annular flange to allow the locking ring to be moved into position. Preferably, internal threads are provided in the cap cooperating with external threads on the neck, and cutouts may be formed in the external thread aligned with the cutout in the annular flange.

20 Claims, 3 Drawing Sheets

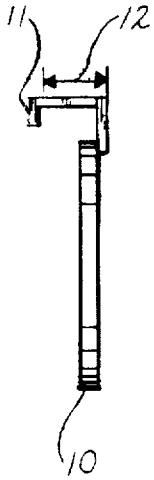
Fig. 1
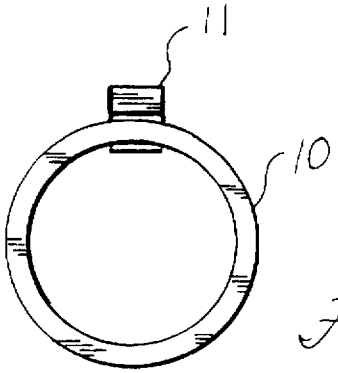
Fig. 2
Fig. 3
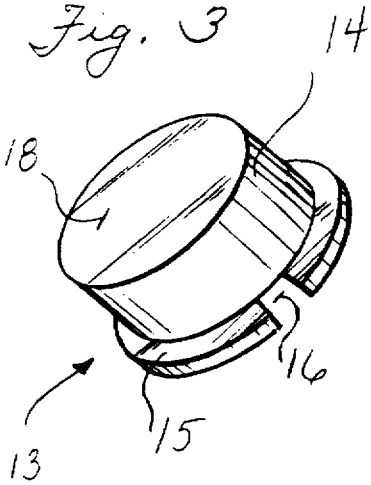
Fig. 4
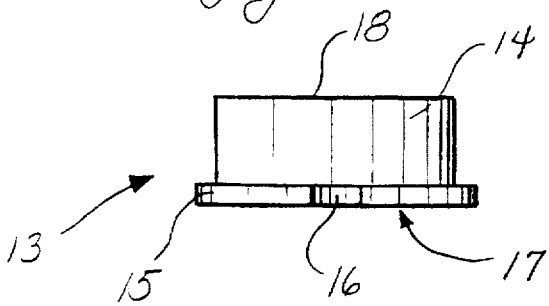
Fig. 5
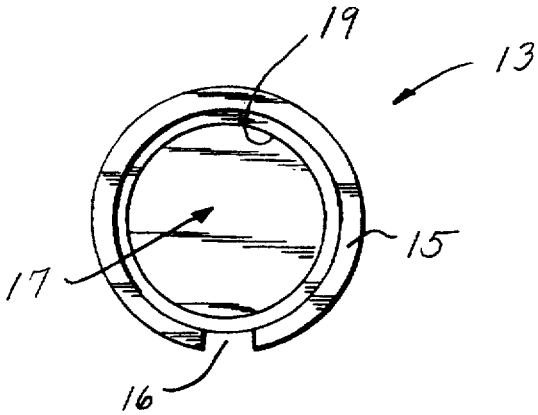

Fig. 7
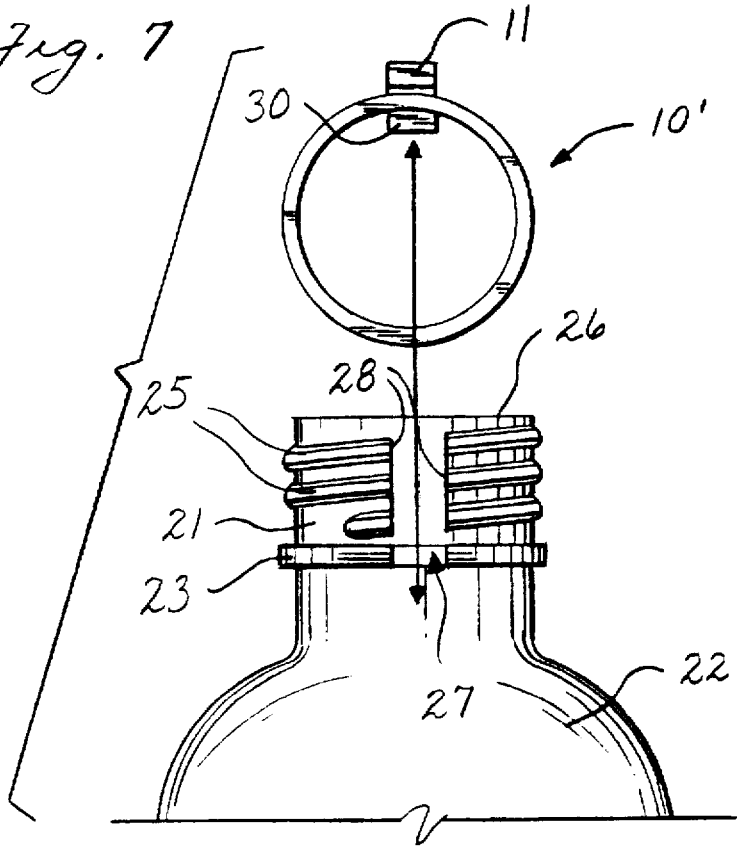
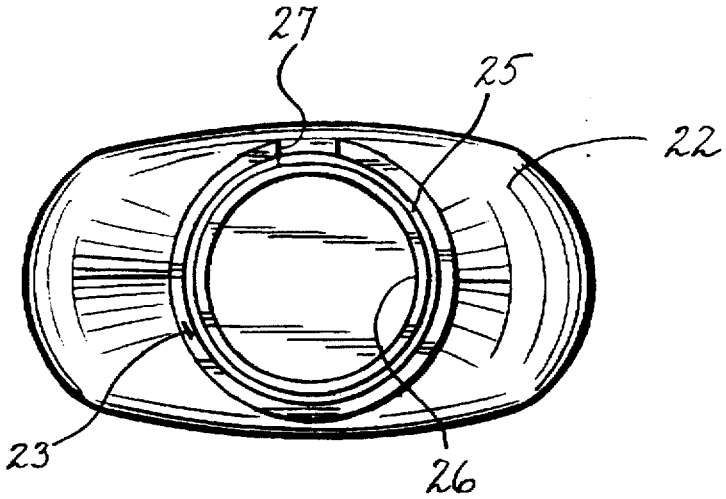
Fig. 8

CHILD RESISTANT CONTAINER CLOSURE SYSTEM WITH LOCKING RING, HOOK ELEMENT, AND CAP

BACKGROUND AND SUMMARY OF THE INVENTION

Containers with child-resistant closure systems, and child-resistant closure systems per se, have widespread usage for all products where it is desirable to prevent access to the contents of the container by small children. Some conventional child-resistant closure systems use snap together components which are difficult for many adults to effectively open, other closure systems are excessively complicated, containing numerous or highly-specialized components, and most conventional closure systems do not provide the option for either utilizing or not utilizing the closure system. Therefore, it is often necessary when determining how medicines should be packaged to either specify child resistant containers or conventional containers. However, it would be more desirable if one had the option of purchasing only one type of container and determining at the place of use whether the container would be child resistant or not.

According to the present invention, a child-resistant closure system, and a container with a child-resistant closure system are provided which overcome the drawbacks of the prior art. The system according to the present invention is simple and inexpensive, yet effective in performing the child-resistant function. It is also versatile, and can by an adult user readily be made into either a child-resistant system or a conventional container system simply by removing the child-resistant element.

According to one aspect of the present invention, a child-resistant closure system for use with a container has an open top (such as a bottle of medicine or a toxic material) is provided. The closure system comprises the following components: A locking ring defining a first plane. A hook element extending upwardly from the ring, substantially perpendicular to the first plane, and integral with the locking ring. A cap adapted to close a container open top, the cap having a substantially cylindrical configuration hollow body including internal threads, and also include a closed first end, an open second end, and an annular lip surrounding the second end and extending outwardly from the hollow body. A notch formed in the lip, having a first width; and the hook element having a second width less than the first width.

Preferably the hook element comprises only a single hook element and the notch comprises only a single notch, although in some embodiments multiple hooks and/or notches may be utilized.

While the locking ring may be fused into place on a container, in the preferred embodiment it is constructed in such a way that it can be removed from the container and thereby turn the container from one having a child-resistant closure system to one in which there is no child-resistant component so that the container operates normally (e.g., by a screw threading the cap on and off). To effect this purpose a radially, inwardly-extending, single flange integral with the locking ring is provided. The radial flange and hook are positioned so that a second plane perpendicular to the first plane substantially bisects the radial flange and hook. Typically, the radial flange extends a first radial distance inwardly from the locking ring and the hook element extends radially outwardly from the locking ring a second radial distance greater than or equal to the first radial distance.

According to another aspect of the present invention, a container with a child-resistant closure system is provided. The container comprises the following components: A container having a top with a neck extending upwardly from the top and defining an upper opening allowing passage of material from within the container therethrough. An annular flange connected to the neck and spaced from the upper opening a first axial distance. A locking ring defining a first plane, the locking ring positioned surrounding the neck on the opposite side of the annular flange from the upper opening, and having an interior cross-sectional area greater than the exterior cross-sectional area of the neck. A hook element extends upwardly from the locking ring to a position on the opposite side of the annular flange from the locking ring. A cap for closing the upper opening, the cap having a substantially cylindrical configuration hollow body including a closed first end, and open second end, and an annular lip surrounding the second end and extending outwardly from the hollow body. A notch formed in the lip, having a first width; and the hook element has a second width slightly less than the first width, and extends upwardly from the locking ring a second axial distance which is greater than the distance between the locking ring and the annular lip when the cap closes the upper opening and the annular lip is adjacent to the annular flange, so that the hook element prevents the cap from being removed from the neck unless the notch and the hook element are in alignment.

The cap hollow body is preferably internally threaded, although other conventional mechanisms may be utilized to fasten the cap onto the neck, including snap-on components, or by providing the cap as deformable, etc. the radially, inwardly-extending radial flange integral with the locking ring is preferably provided, the flange having a third width, and a cutout is formed in the annular flange having a fourth width slightly greater than (i.e., less than 20% greater than) the third width so that the locking ring may be moved over the annular flange and the radial flange and the cutout are in alignment. The locking ring and the radial flange are so dimensioned that the locking ring cannot move past the annular flange when the radial flange and the cutout are not aligned.

The container neck exterior threads may also have cutouts that are in alignment with the annular flange cutout to allow the locking ring to pass over the threads when the radial flange is in alignment with the cutouts. The details of the locking ring and the radial flange may be as described above. In the preferred embodiment, the annular flange, cap and locking ring are all of a suitable conventional hard plastic (such as the conventional plastics presently used for medicine containers and the like) and the closure system consists of the annular flange, cap and locking ring.

According to another aspect of the present invention, a method of using a container with a child-resistant closure system as described above is provided. The method comprises the following steps: (a) Sliding the locking ring over the container neck with the radial flange and cutout in alignment, and then moving the locking ring so that the radial flange and cutout are misaligned. (b) Moving the cap onto the neck to close the upper opening and so that the annular lip is adjacent the hook element. (c) Aligning the hook element and the notch in the annular lip, and moving the cap toward the annular flange, so that the hook element passes through the notch. And then (d) misaligning the hook element and the notch so that the cap is retained on the container neck by the hook elements and locking ring. Preferably, the cap is internally screw threaded and the neck is externally screw threaded, and step (b) is practiced by effecting relative rotation between the cap and the neck with the screw threads in engagement. There is also preferably the further step (e) of removing the locking ring by removing the cap and passing the radial flange to the cutout to transform the container into a conventional container.

It is a primary object of the present invention to provide a simple yet effective container with a child resistant closure system, and such a closure system per se. This and other objects of the invention will become clear from an inspection of a detailed description of the invention and from the appended claims.

BRIEF DESCRIPTION OF THE DRAWINGS

FIG. 1 is a side elevational view of a locking ring of a closure system according to the present invention;

FIG. 2 is a is a top plan view of the locking ring of FIG. 1;

FIG. 3 is a top perspective view of a cap of a closure system according to the present invention;

FIG. 4 is a side elevational view of the cap of FIG. 3;

FIG. 5 is a bottom view of the cap of FIG. 3;

FIG. 7 is a detail side view of an exemplary container according to the invention and top view of a modified locking ring; and FIG. 8 is a top plan view of the container of FIG. 7.

DETAILED DESCRIPTION OF THE DRAWINGS

Figure 6:
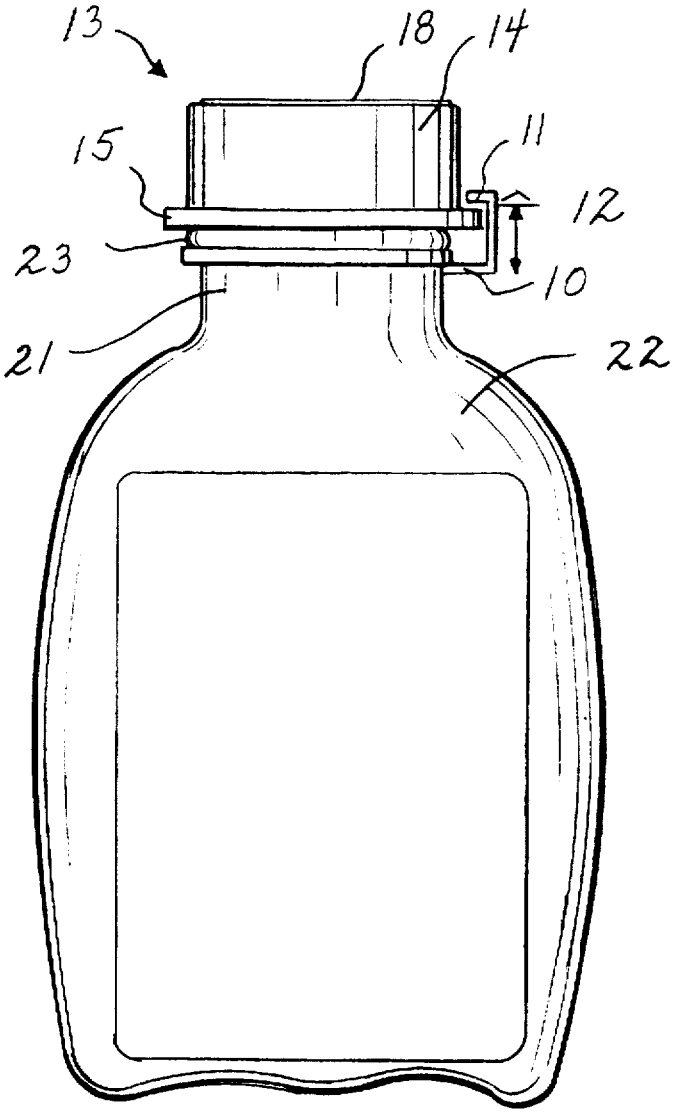
FIG. 6 is a side view of an exemplary container with the closure system of FIGS. 1 through 5 in place thereon, closing the open top of the container.

FIGS. 1 and 2 illustrate an exemplary locking ring 10 according to the present invention. The locking ring 10 is preferably formed of a hard plastic material and includes a hook element 11 extending substantially perpendicular to a plane formed by the ring 10. The hook element 11 is spaced a distance 12 from the plane containing the locking ring 10 as seen in FIG. 1, which distance is sufficient to receive the annular lip of the cap as hereinafter described.

The second component of the closure system according to the present invention, in addition to the locking ring 10, is a cap 13, seen in FIGS. 3 through 5. The cap 13 is adapted to close a container open top and has a substantially cylindrical configuration hollow body 14, as is clear from all of FIGS. 3 through 5. The hollow body 14 has an annular lip 15 with a notch 16 therein formed at an open second end 17 of the body 14, opposite a closed first end 18. The notch 16 has a width which is greater than the width of the hook element 11 of the locking ring 10. Preferably the width of the notch 16 is only slightly greater (i.e., less than 20% greater) than the width of the hook element 11, and the thickness of the annular lip 15 and the spacing 12 of the hook element 11 and the relative diameters of the locking ring 10 and the annular lip 15 are provided so that the hook element 11 can only move past the annular lip 15. When it passes through the notch 16, then the notch 16 and hook element 11 are aligned. The hook element prevents detachment of the locking ring 10 from the cap 13.

FIG. 6 shows the closure system of FIGS. 1 through 5 in combination with a neck 21 of a conventional container 22. The container 22 is shown as a conventional plastic bottle for containing medicines that children should not have access to, as illustrated in FIG. 6, but it is to be understood that the container 22 may be of any conventional shape, size, and material, and may include any product or material that children should not have access to. The container 22 also includes an annular flange 23 disposed between the bottom of the neck 21 and the open top of the neck 21, the annular flange 23 retaining the locking ring 10 on the neck 21. The annular flange 23 may be continuous and have an exterior cross-sectional area (or diameter) of the locking ring 10 dimensioned so that the locking ring 10 cannot move upwardly past flange 23. The locking ring 10 may be fused into place around the neck 21.

FIGS. 7 and 8 show another embodiment of the container and locking ring according to the present invention which is particularly advantageous and allows the container to be used either with or without a child resistant closure system. For the ring 10' of FIG. 7 a radially-inwardly extending radial flange 30 is provided. While the flange 30 may be provided in any location in the interior of the ring 10', in the preferred embodiment, it is positioned in the same area as the hook element 1 ; that is, as seen in FIG. 7 the radial flange 30 and the hook element 11 are positioned so that a second plane perpendicular to the plane of the locking ring 10 substantially bisects the radial flange 30 and the hook 11. The radial flange 30 extends a first radial distance inwardly from the locking ring 10' and the hook element 11 extends radially outwardly from the locking ring 10' a second radial distance greater than or equal to the first radial distance.

FIGS. 7 and 8 show a particularly desirable container 22 according to the present invention, which cooperates with the cap 13 having internal threads 19 (see FIG. 5). While caps 13 with other systems for connecting the cap to the container neck 21 may be provided, internal screw threads 19 are preferred.

A container 22 as seen in FIGS. 7 and 8 has an upper opening 26 at the top thereof through which materials from inside the container 22 are dispensed, and preferably has external threads 25 which cooperate with the internal threads 19 of the cap 13. A cutout 27 is provided in the annular flange 23, and cooperating cutouts 28 are provided in the threads 25 (where necessary) in alignment with the cutout 27.

By providing the radial flange 30 and by providing the particular dimensions of the locking ring 10' and the radial flange 30 with respect to the container components earlier described either a child resistant or a conventional container may be provided.

The cutout 27 has a third width which is slightly greater than the fourth width of the radial flange 30. The cutouts 28 have approximately the same width as the cutout 27. With this arrangement the locking ring 10' may be slipped onto the container neck 21 so that a child-resistant closure system is provided, the radial flange 30 passing through the cutouts 28 and then through the cutout 27. When the locking ring 10' is then turned slightly with respect to the flange 23 so that the cutout 27 and the radial flange 30 are misaligned, the locking ring 10' cannot be detached from the container neck 21.

It will thus be seen that the closure system according to the present invention is very simple, merely comprising conventional annular flange 23 having only the desired modification in the form of a cutout 27, a conventional cap 13 having as the only modification thereof, an annular lip 15 with a notch 16 therein, and a simple plastic locking ring 10, 10'. When the locking ring 10' is utilized, it is placed over the neck 21 with the hook element 11 extending upwardly, and the radial flange 30 aligned with the cutouts 28, 27 is moved downwardly until the radial flange 30 is below the annular flange 23, and the ring 10' is turned slightly. Then the cap 13 is put onto the top of the neck 21 and the threads 19, 25 moved into engagement and the cap 13 rotated to screw it onto the neck 21. Once it reaches the area of the locking ring 10', the hook element 11 and the notch 16 are aligned so that the hook element 11 is moved above the annular lip 15, and then any further threading that is necessary is provided and the hook element 11 and the notch 16 are misaligned. Then, the locking ring 10' acts as a child-resistant element, not allowing detachment of the cap 13 unless the person attempting the detachment has knowledge and dexterity to align the hook element 11 and the notch 16 while at approximately the same time turning the cap 13 to unscrew it. Whenever it is desired to convert the container 22 into one without a child-resistant feature, all that is necessary is to remove the cap 13 and then remove the locking ring 10' by aligning the radial flange 30 with the cutouts 27 and 28, and pulling upwardly on the locking ring 10' to detach it from the container 22.

It will thus be seen that according to the present invention a simple, yet effective, child resistant closure system, and container with a child-resistant closure system, have been provided, having numerous advantages. While the invention has been herein shown and described in what is presently conceived to be the most practical and preferred embodiment, it will be apparent to those of ordinary skill in the art that many modifications may be made thereof within the scope of the invention which invention is to be accorded the broadest interpretation of the appended claims so as to encompass all equivalent structures and procedures.

What is claimed is:

1. A child resistant closure system for use with a container having a neck and an open top, comprising:

a locking ring defining a first plane;

a hook element extending axially upwardly from said locking ring, substantially perpendicular to said first plane, and integral with said locking ring;

a cap adapted to close a container open top, said cap having a substantially cylindrical configuration hollow body including internal threads, and also including a closed first end, an open second end, and an annular lip surrounding said second end and extending outwardly from said hollow body;

a notch formed in said lip, having a first width;

said hook element having a second width less than said first width; and said ring and hook element dimensioned so that when said cap and ring are on a container neck said hook is radially outwardly of said cap, and said hook can pass through said notch if said hook and notch are aligned.

2. A closure system as recited in claim 1 wherein said hook element comprises only a single hook element, and wherein said notch comprises only a single notch.

3. A closure system as recited in claim 2 further comprising a radially inwardly-extending single flange integral with said locking ring.

4. A closure system as recited in claim 3 wherein said flange and hook are positioned so that a second plane perpendicular to said first plane substantially bisects said flange and hook.

5. A closure system as recited in claim 4 wherein said flange extends a first radial distance radially inwardly from said locking ring and said hook element extends radially outwardly from said locking ring a second radial distance at least as great as said first radial distance.

6. A closure system as recited in claim 3 wherein said flange extends a first radial distance radially inwardly from said locking ring and said hook element extends radially outwardly from said locking ring a second radial distance at least as great as said first radial distance.

7. A closure system as recited in claim 1 further comprising a radially inwardly-extending flange integral with said locking ring.

8. A container with a child resistant closure system, comprising:

a container having a top with a neck extending axially upwardly from said top and defining an upper opening allowing passage of material from within said container therethrough;

an annular flange connected to said neck and spaced from said upper opening a first axial distance;

a locking ring defining a first plane, said locking ring positioned surrounding said neck on the opposite side of said annular flange from said upper opening, and having an interior cross-sectional area greater than the exterior cross-sectional area of said neck;

a hook element extending axially upwardly from said locking ring to a position on the opposite side of said annular flange from said locking ring;

a cap for closing said upper opening, said cap having a substantially cylindrical configuration hollow body including a closed first end, an open second end, and an annular lip surrounding said second end and extending radially outwardly from said hollow body;

a notch formed in said lip, having a first width; and said hook element having a second width slightly less than said first width, and extending axially upwardly from said locking ring a second axial distance which is greater than the distance between said locking ring and said annular lip when said cap closes said upper opening and said annular lip is adjacent to said annular flange, so that said hook element prevents said cap from being removed from said neck unless said notch and said hook element are in alignment.

9. A container as recited in claim 8 wherein said cap hollow body is internally threaded and said neck has cooperating external threads.

10. A container as recited in claim 9 further comprising a radially inwardly-extending flange, said flange having a third width radial flange integral with said locking ring; and a cutout in said annular flange having a fourth width slightly greater than said third width so that said locking ring may be moved over said annular flange when said radial flange and said cutout are in alignment, but said locking ring and radial flange being so dimensioned that said locking ring cannot move past said annular flange when said radial flange and said cutout are not aligned.

11. A container as recited in claim 10, wherein said container neck exterior threads have cutouts therein in alignment with said annular flange cutout to allow said locking ring to pass over said threads when said radial flange is in alignment with said cutouts.

12. A container as recited in claim 10 wherein said radial flange and hook are positioned so that a second plane perpendicular to said first plane substantially bisects said radial flange and hook.

13. A container as recited in claim 12 wherein said flange extends a first radial distance inwardly from said locking ring and said lock element extends radially outwardly from said locking ring a second radial distance greater than or equal to said first radial distance.

14. A container as recited in claim 8 wherein said hook element comprises only a single hook element, and wherein said notch comprises only a single notch.

15. A container as recited in claim 14 further comprising a radially, inwardly-extending flange, said flange having a third width radial flange integral with said locking ring; and a cutout in said annular flange having a fourth width slightly greater than said third width so that said locking ring may be moved over said annular flange when said radial flange and said cutout are in alignment, but said locking ring and radial flange being so dimensioned that said locking ring cannot move past said annular flange when said radial flange and said cutout are not aligned.

16. A container as recited in claim 15 wherein said flange and hook are positioned so that a second plane perpendicular to said first plane substantially bisects said flange and hook.

17. A container as recited in claim 16 wherein said flange extends a first radial distance inwardly from said locking ring and said lock element extends radially outwardly from said locking ring a second radial distance greater than or equal to said first radial distance.

18. A container as recited in claim 8, wherein said annular flange, cap, and locking ring are all of hard plastic, and said closure system consists of said annular flange, cap and locking ring.

19. A method of using a container having a neck and upper opening with a child-resistant closure system including a locking ring with an integral axially extending hook element, a cap having a closed first end and an annular lip surrounding an open second end, with a notch formed in the lip, and a radially inwardly extending flange positioned opposite the hook, said method comprising the steps of:

(a) sliding the locking ring over the container neck with the radial flange and cutout in alignment, and then moving the locking ring so that the radial flange and cutout are misaligned;

(b) moving the cap onto the neck to close the upper opening and so that the annular lip is adjacent the hook element;

(c) aligning the hook element and the notch in the annular lip, and moving the cap toward the annular flange, so that the hook element passes through the notch; and then (d) misaligning the hook element and the notch so that the cap is retained on the container neck by the hook element and locking ring.

20. A method as recited in claim 19 wherein the cap is internally screw-threaded and the neck is externally screw-threaded, and wherein step (b) is practiced by effecting relative rotation between the cap and the neck with the screw threads in engagement; and comprising the further step (e) of removing the locking ring by removing the cap and passing the radial flange through the cutout, to transform the container into a conventional container.

* * * * *